US005299109A

United States Patent [19]

Grondal

[11] Patent Number: 5,299,109

[45] Date of Patent: Mar. 29, 1994

[54] LED EXIT LIGHT FIXTURE

[75] Inventor: Daniel Grondal, Bethel, Conn.

[73] Assignee: High Lites, Inc., Waterbury, Conn.

[21] Appl. No.: 974,092

[22] Filed: Nov. 10, 1992

[51] Int. Cl.[5] ..... F21V 7/02

[52] U.S. Cl. ..... 362/241; 362/247; 362/260; 362/300; 362/800; 362/812; 40/570; 40/574; 40/582

[58] Field of Search ..... 40/219, 544, 570, 574, 40/582, 615; 362/244, 245, 227, 260, 300, 301, 307, 311, 800, 812, 241, 247

[56] References Cited

U.S. PATENT DOCUMENTS

| | | | |
|---|---|---|---|
| 4,005,538 | 2/1977 | Tung | 40/582 |
| 4,139,955 | 2/1979 | Reiback | 40/219 |
| 4,779,166 | 10/1988 | Tanaka et al. | 362/31 |
| 5,008,788 | 4/1991 | Palinkas | 362/800 |
| 5,018,290 | 5/1991 | Kozek et al. | 362/812 |
| 5,027,258 | 6/1991 | Schoniger et al. | 362/812 |
| 5,105,568 | 4/1992 | Branning | 40/570 |
| 5,138,782 | 8/1992 | Mizobe | 40/219 |

FOREIGN PATENT DOCUMENTS

| | | | |
|---|---|---|---|
| 7804238 | 10/1979 | Netherlands | 40/582 |

*Primary Examiner*—Richard R. Cole
*Assistant Examiner*—Alan B. Cariaso
*Attorney, Agent, or Firm*—Fitzpatrick, Cella, Harper & Scinto

[57] ABSTRACT

An emergency light fixture is disclosed which includes a frame and a cover for the frame that has translucent and non-translucent portions thereon. The translucent portions of the cover define the word EXIT. The cover is indirectly lit from the interior of the fixture by an array of light emitting diodes mounted in the frame beneath the cover. The light emitting diodes are positioned directly beneath the non-translucent portions of the cover adjacent the translucent portions thereof in order to provide a uniform illumination to the translucent portions of the cover.

11 Claims, 3 Drawing Sheets

LED EXIT LIGHT FIXTURE

The present invention relates to lighting fixtures, and more in particular to an emergency exit light fixture.

In recent years, revisions to various safety and fire codes throughout the United States have required the expanded use of emergency exit lighting fixtures, which typically have a translucent face bearing the word EXIT on it. In the past, such fixtures typically have been lit by fluorescent or incandescent bulbs. Such fixtures are quite bulky and intrusive in the aesthetic decor of an office setting or the like. Accordingly, manufacturers have been attempting to create emergency lighting fixtures which have a sleeker, more modern appearance to be less obtrusive in an aesthetic sense, while still providing the necessary emergency lighting and direction.

One such proposed exit sign construction is disclosed in U.S. Pat. No. 5,018,290 which describes a device using an array of small incandescent bulbs positioned adjacent the letters of the sign. Incandescent lights of this type produce white light and intense lighted areas with small light spread. Accordingly the illumination of the letters of the sign is not uniform and will vary materially along the surface of the sign.

Some attempts also have been made to use light emitting diodes to illuminate emergency signs. U.S. Pat. No. 3,309,806 discloses two such arrangements. In one embodiment a uniform array of LED's are provided on a circuit board so that most, if not all LED's are directly behind the transparent letters of the sign, while an alternative embodiment has the LED's positioned only in positions corresponding to the letters or symbols to be illuminated. The problem with such fixtures is that the LED's, which produce very narrow light beams of 10° to 100° will produce "hot spots" of intense light directly behind the letters and will not produce uniform lighting. As a result should one or more of the light emitting diodes fail, the sign becomes unintelligible.

It is an object of the present invention to provide an emergency exit or directional lighting fixture which is relatively thin in construction and reliable in use.

Another object of the present invention is to provide an emergency lighting fixture which utilizes light emitting diodes, but which continues to be legible should one of the diodes fail.

A still further object of the present invention is to provide an emergency lighting fixture which is constructed to provide a thin, non-obtrusive fixture.

A further object of this invention is to produce an aesthetically pleasing light fixture.

Yet another object of the present invention is to provide an emergency lighting fixture which is easily manufactured and durable in construction.

In accordance with an aspect of the present invention, an emergency lighting fixture is provided which includes a frame having at least one open side and a cover removable mounted on the frame over the open side. The cover includes a translucent portion defining an intelligible indicia, such as the word EXIT or an arrow sign. An array of light emitting diodes is mounted in the frame beneath the cover with the diodes being positioned directly beneath the non-translucent portions of the cover and adjacent the translucent portions thereof. As a result, the translucent portions of the cover are illuminated from the side by indirect lighting so that the diodes are not exposed to view and the light generated by the diodes is spread throughout the fixture behind the translucent portions thereof. The fixture thus has an appearance, when lit, of a conventional fixture, but it is relatively thin in construction. Improved lighting of the translucent portions of the fixture is achieved by mounting the diodes on a circuit board which is coated with a reflective material and also by providing reflective material on the back surface of the cover itself.

The above, and other objects, features and advantages of this invention will be apparent in the following detailed description of an illustrative embodiment thereof, which is to be read in connection with the accompanying drawings, wherein.

Figure 1:
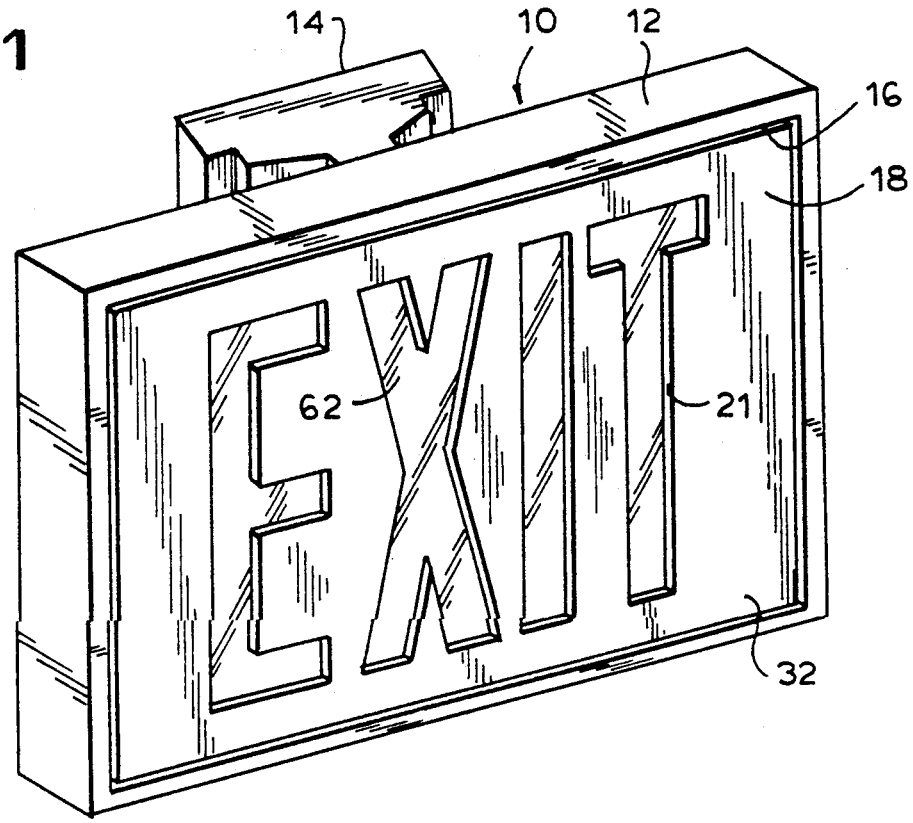
FIG. 1 is a perspective view of an emergency EXIT lighting fixture constructed in accordance with the present invention.

Referring now to the drawings in detail, and initially to FIG. 1 thereof, a light fixture 10 constructed in accordance with the present invention is illustrated. The light fixture includes a peripheral frame 12 which is generally rectangular and relatively thin. A mounting element 14 is secured to the rear of the fixture in any convenient manner and includes the electrical transformer and wiring necessary to supply power to the light emitting diodes contained within the frame 12. However, the particular transformer and electrical circuitry used in the lamp does not form part of this invention and therefore is not described herein in detail.

Frame 12 has an open front side 16 which is selectively closed by a cover 18. The latter is pivotally mounted on frame 12 to permit access to the interior of the frame.

Figure 4:
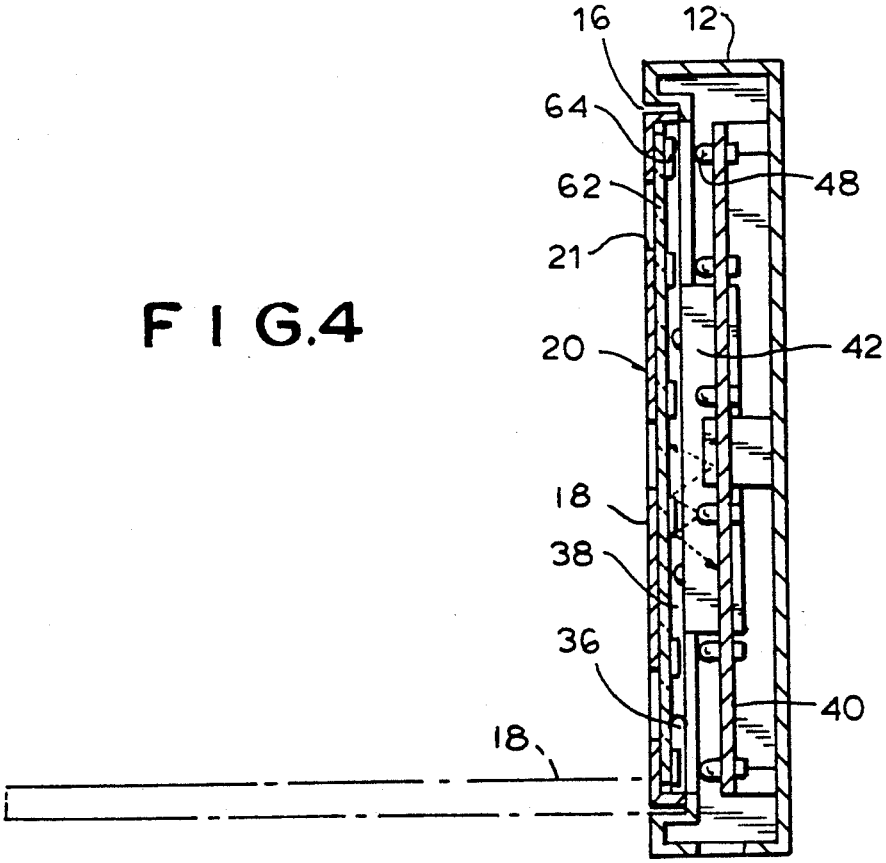
FIG. 4 is a sectional view taken along line 4—4 of FIG. 3.
Figure 2:
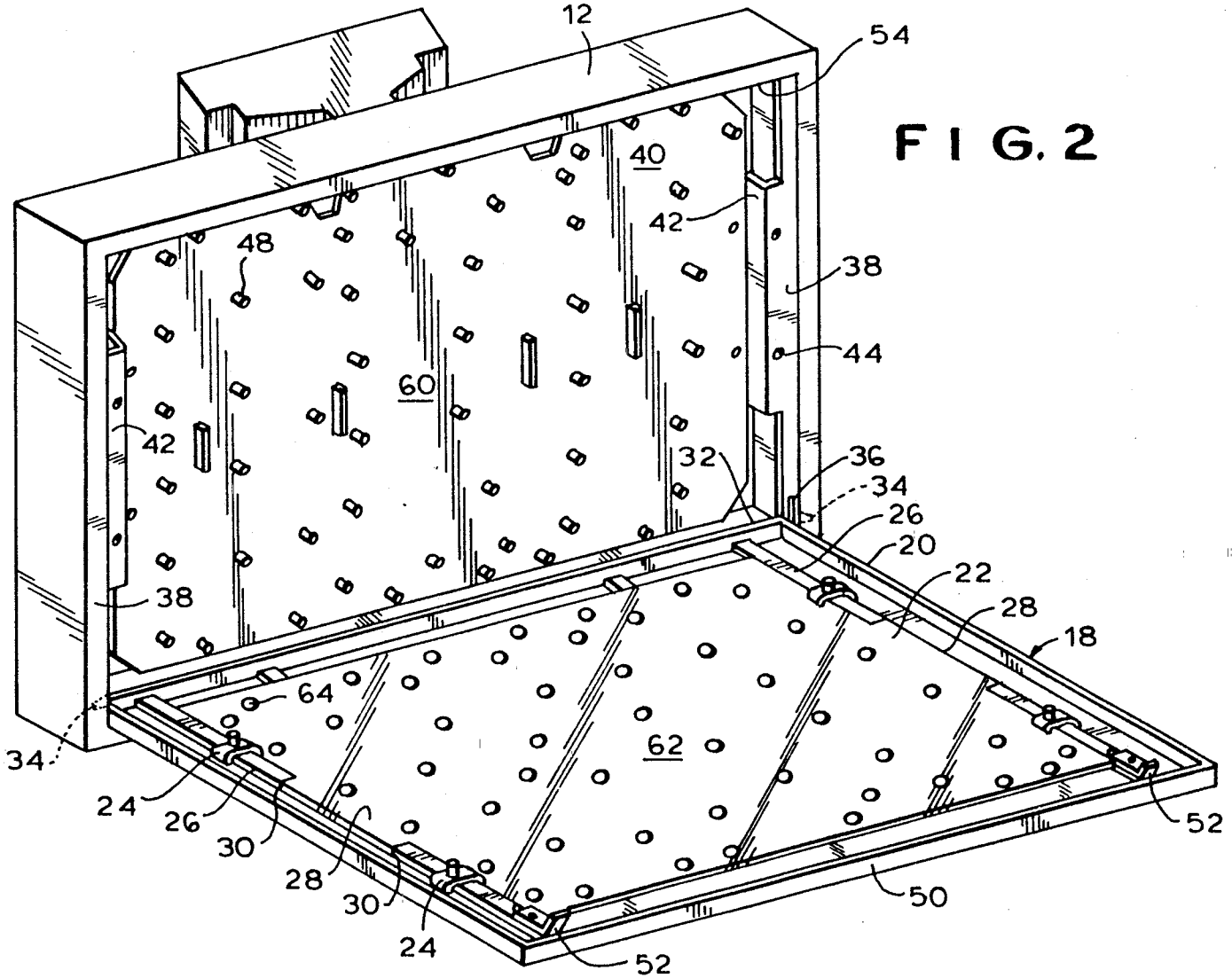
FIG. 2 is a perspective view similar to FIG. 1 with the cover of the light fixture open.

As illustrated in FIGS. 2 and 4, cover 18 includes a solid, preferably metal first cover element 20 in which the letters of the word EXIT are cut or formed as perforations in the otherwise non-translucent cover element. A second cover element 22, formed of translucent plastic material or the like (preferably in red or white transparent colors), is removable mounted on the rear of cover element 20. For example, as illustrated in FIG. 2, plastic sheet 22 is held in place on the back of cover 20 by spring fingers or clips 24 mounted along reinforcing bar elements 26 integrally formed on the back of the cover element. To help locate and stabilize cover element 22 with respect to the cover element 20, sheet 22 has extensions 28 formed along two opposed sides thereof which fit between the ends 30 of bars 26.

The lower end 32 of cover element 20 has extending ears or fingers 34 (seen in dotted lines in FIG. 2) which are received in slots 36 formed in the side walls 38 of frame number 16. This arrangement permits cover element 20 to pivot on frame 12 while also permitting it to be removed from the frame by tilting fingers 34 out of the slots 36 if desired.

The upper edge 50 of cover element 20 has spring clips 52 secured thereto which will snap into place against the inner surface of the upper edge 54 of frame element 12 to hold the cover releasably in its closed position.

A circuit or mounting board 40 is mounted within the confines of frame 12 in any convenient manner. As illustrated in the embodiment shown in FIG. 2, Z-shaped brackets 42 are secured on opposed side edges of board 40 and also secured to frame 12 by screws 44, or the like. The circuit board 40, on its rear surface, contains the electrical wiring or circuitry (not shown) for operating the lamp. The circuitry is connected to a plurality of light emitting diodes 48 of conventional construction which are mounted on the front side of the circuit board in any convenient or known manner. LED's are particularly desirable for this application since the can be selected to produce a variety of colors such as green, red, or yellow.

Figure 3:
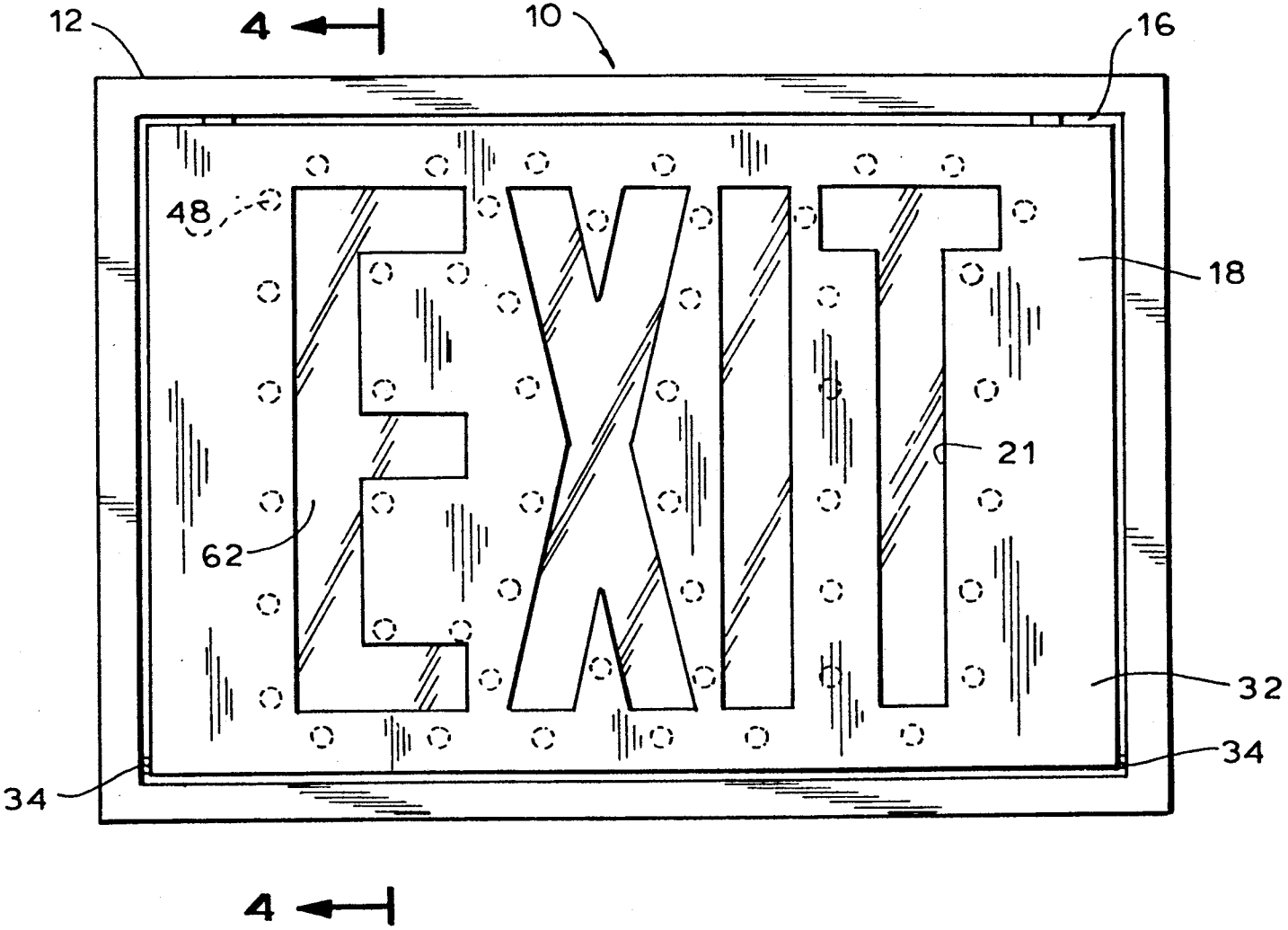
FIG. 3 is a plan view of the fixture illustrated in FIG. 1, with the cover closed and showing the location of the light emitting diodes in dotted lines.

In accordance with a principal feature of the present invention, light emitting diodes 48 are arranged in a predetermined pattern, as illustrated in FIGS. 2 and 3. In particular, the diodes are arranged so that they are directly beneath the non-translucent portion of the cover as defined by cover element 20, adjacent to the openings 21 which define the individual letters of the word EXIT, but not beneath the translucent portions of the cover as defined by the sheet 22 and the cutout letters. As a result, the letters are indirectly lit by the light emitting diodes, without points of light or "hot spots"being exposed. Thus, should any one or more of the diodes fail, the letters will remain lit by the indirect lighting produced by the light emitting diodes. In addition, because light emitting diodes are used, only a very small space needs to be provided within the frame 12 so that the fixture can be very thin in construction.

Applicant has found that the specific array of the light emitting diodes shown in the drawings provides an optimal lighting effect even if some of the LED's fail. However the number of LED's may be increased or decreased to vary the intensity of illumination.

In order to further improve the indirect lighting of the fixture by the light emitting diodes used in the present invention, the front surface 60 of circuit board 40 is coated with a light reflective material, such as for example white paint or reflective powder. In addition, the rear surface 62 of cove element 22 is coated at predetermined locations, as shown by the circles 64, with circular spots of the reflective material. These reflective spots are located to be aligned with the light emitting diodes when the cover 18 is closed. Thus, the light from the light emitting diodes will be reflected by the reflective spots 64 back to the surface 40 and back to the surface 60 and then through the translucent portion of the cover defined by the cutouts for the letters in the word EXIT.

It has been found that a fluorescent reflective coating or paint colored to the same color as the LED will produce optimal uniform illumination of the sign. Day-Glo Sunbonded brushing paint sold by Day-Glo Color Corp. has been found to be a highly satisfactory coating for this purpose. The use of a fluorescent paint on this way produces multiple reflections of light within the frame of the fixture to produce uniform indirect lighting.

Of course, it is to be understood that the invention can be used with other forms of indicia besides the word EXIT, i.e., it can be used with other words or with symbols. In any case, the light emitting diodes are located around the periphery of the translucent letters, below the non-translucent portions of the cover.

Although an illustrative embodiment of the present invention has been described herein with reference to the accompanying drawings, it is to be understood that the invention is not limited to that precise embodiment, and that various changes and modifications may be affected therein by those skilled in the art without departing from the scope or spirit of this invention.

What is claimed is:

1. An emergency light fixture comprising a frame, a cover movably mounted on the frame for movement between an open position and a closed position adjacent the frame, said cover including translucent and non-translucent portions therein, said translucent portions having a predetermined configuration; and an array of light emitting diodes mounted on said frame beneath said cover; said light emitting diodes being positioned in the frame directly beneath the non-translucent portion of the cover and adjacent the translucent portions thereof when the cover is in the closed position; said cover having individual light reflective surfaces respectively associated with each of said light emitting diodes and located on the cover to be directly above the respective diodes within the non-translucent portions of the cover when the cover is in its closed position; and said light emitting diodes being mounted on a board in said frame having a surface facing said cover and said surface being coated with a reflective material.

2. An emergency light fixture as defined in claim 1 wherein said translucent portions of the cover define the word EXIT and said light emitting diodes are arrayed about the letters of the word beneath the non-translucent portions of the cover to provide indirect light to the translucent portions of the cover.

3. An emergency light fixture as defined in claim 2 wherein said cover comprises a first non-translucent cover element having the word EXIT formed by apertures therein and a second translucent cover element removable mounted on the first cover element between the first cover element and said diodes.

4. An emergency light as defined in claim 3 wherein said cover is pivotally mounted in said frame.

5. An emergency light as defined in claim 2 wherein said board on which the light emitting diodes are mounted is a circuit board.

6. An emergency light as defined in claim 5 wherein the reflective surfaces on the cover and the reflective material on the circuit board are formed of a fluorescent paint.

7. An emergency light fixture comprising a frame having at least one open side, a cover removably mounted on said frame over said open side, said cover including a translucent portion and non-translucent portions therein, said translucent portions defining intelligible indicia, and an array of light emitting diodes mounted in said frame beneath said cover; said light emitting diodes being positioned in the frame directly beneath the non-translucent portions of the cover and adjacent the translucent portions thereof; individual light reflective surfaces respectively associated with each of said light emitting diodes and located on the cover to be directly above the respective diodes within the non-translucent portions of the cover; said light emitting diodes being mounted on a board within said frame, and said board having a light reflecting surface facing said cover.

8. An emergency light fixture as defined in claim 7 wherein the translucent portions of the cover define the word EXIT and said light emitting diodes are arrayed about the letters of the word beneath the non-translucent portions of the cover.

9. An emergency light fixture as defined in claim 8 wherein said cover comprises a first non-translucent cover element having the word EXIT formed by apertures therein and a second translucent cover element removable mounted on the first cover element between the first cover element and said diodes.

10. An emergency light as defined in claim 9 wherein said cover is pivotally mounted in said frame.

11. An emergency light as defined in claim 7 wherein the light reflective surfaces on the cover and the light reflective surface on the board formed of a fluorescent paint.

* * * * *